US006803575B2

(12) United States Patent
McLaughlin

(10) Patent No.: US 6,803,575 B2
(45) Date of Patent: Oct. 12, 2004

(54) INFRA-RED LASER DEVICE AND METHOD FOR SEARCHING FOR LOST ITEM

(75) Inventor: William L. McLaughlin, Philadelphia, PA (US)

(73) Assignee: Lost Item Retreival Systems Inc, Southampton, PA (US)

( * ) Notice: Subject to any disclaimer, the term of this patent is extended or adjusted under 35 U.S.C. 154(b) by 194 days.

(21) Appl. No.: 10/015,798

(22) Filed: Nov. 2, 2001

(65) Prior Publication Data

US 2002/0082120 A1 Jun. 27, 2002

Related U.S. Application Data

(62) Division of application No. 09/235,618, filed on Jan. 21, 1999, now Pat. No. 6,482,108.

(51) Int. Cl.[7] ..... A63B 43/06
(52) U.S. Cl. ..... 250/338.1; 340/540
(58) Field of Search ..... 250/338.1; 340/540; 473/353

(56) References Cited

U.S. PATENT DOCUMENTS

| | | | | | |
|---|---|---|---|---|---|
| 3,782,730 | A | * | 1/1974 | Horchler | 473/353 |
| 5,112,055 | A | * | 5/1992 | Barnhill | 473/199 |
| 5,132,622 | A | * | 7/1992 | Valentino | 324/326 |
| 5,370,387 | A | * | 12/1994 | Baker | 294/19.2 |
| 5,423,549 | A | * | 6/1995 | Englmeier | 473/353 |
| 5,626,531 | A | | 5/1997 | Little | |
| 5,662,533 | A | | 9/1997 | Chadwell | |
| 5,662,534 | A | * | 9/1997 | Kroll et al. | 473/353 |
| 5,910,057 | A | | 6/1999 | Quimby | |
| 6,113,504 | A | * | 9/2000 | Kuesters | 473/353 |
| 6,353,386 | B1 | * | 3/2002 | Castonguay et al. | 340/540 |
| 2002/0173378 | A1 | * | 11/2002 | Tinsman | 473/351 |

FOREIGN PATENT DOCUMENTS

| | | | | |
|---|---|---|---|---|
| DE | 19804126 | A1 * | 8/1999 | A63B/57/00 |
| JP | 5-337218 | A * | 12/1993 | A63B/43/00 |

OTHER PUBLICATIONS

Heatley IWW Communications Dec. 1998 pp. 72–82.

* cited by examiner

*Primary Examiner*—Constantine Hannaher
*Assistant Examiner*—Otilia Gabor
(74) *Attorney, Agent, or Firm*—John R. Ewbank

(57) ABSTRACT

An ordinary golf ball is cleaned and then treated with an emulsion depositing in the dimples a hologram having the capacity to reflect a pre-selected wavelength of laser-beam. If a player temporarily looses such ball, a hand-held unit directs an infra-red laser beam of said pre-selected wavelength, desirably one not absorbed by atmospheric moisture, such as 1310 nm. Said hand-held unit contains an analyzer evaluating the light reflected back to such analyzer and attributable to such laser beam of said pre-selected wave-length. By evaluating the intensity of such reflected light, the golfer can target the location of the temporarily lost ball. Upon approaching the lost ball the angle at which the unit would be held would be modified for focusing on the ball. Earphones, meters, or other diagnostic equipment can monitor the intensity of the light reflected back from such laser beam. Such hand held analyzer of reflected light involves an investment which is small enough that a golf club can include the rental of such a unit as a part of the rental for a golf cart. Preliminary estimates indicated that any country club failing to utilize the present invention will encounter greater losses from lost balls than those practicing the present invention, because the cost of periodically regenerating the hologram for a ball represent such a small fraction of the cost of a replacement ball.

8 Claims, 3 Drawing Sheets

FIG.1
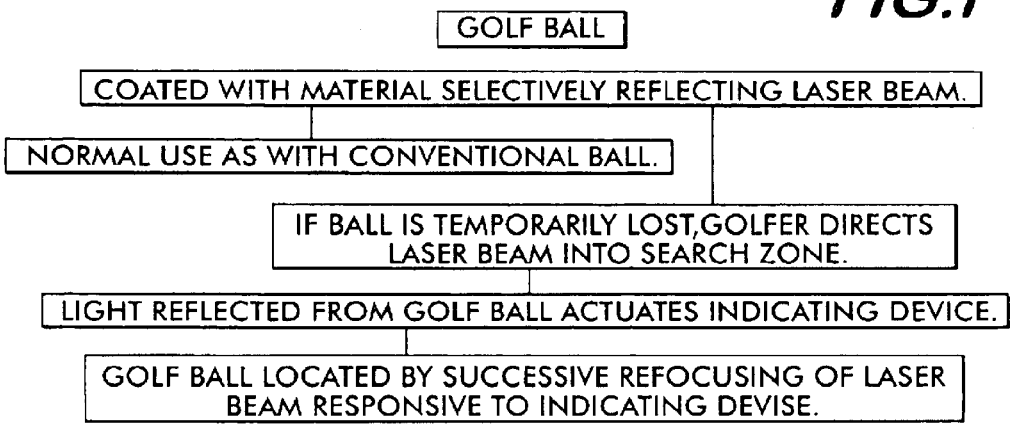
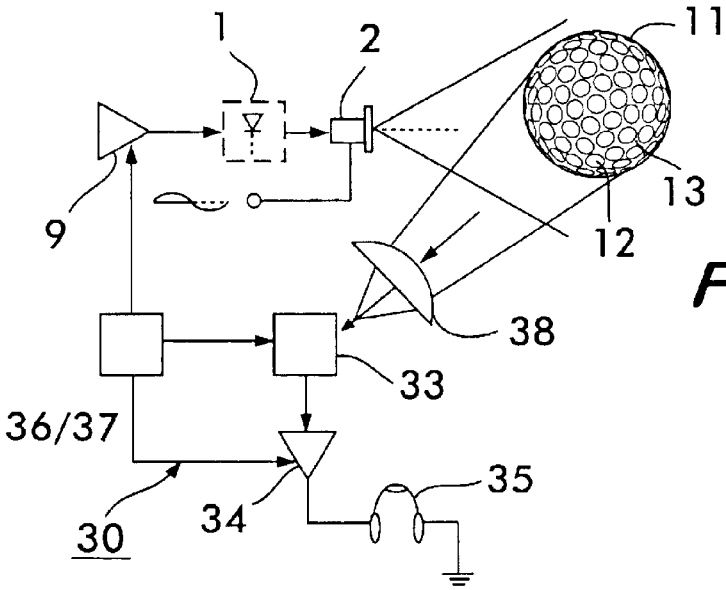
FIG.2
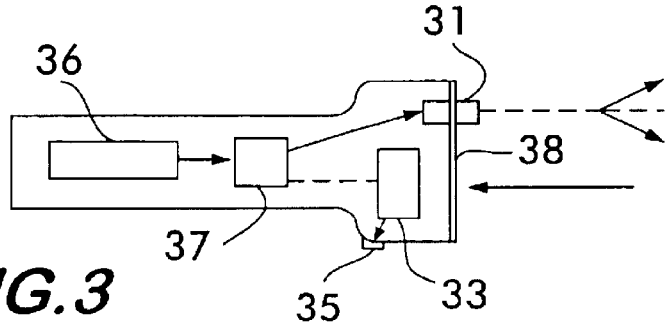
FIG.3

FIG. 7
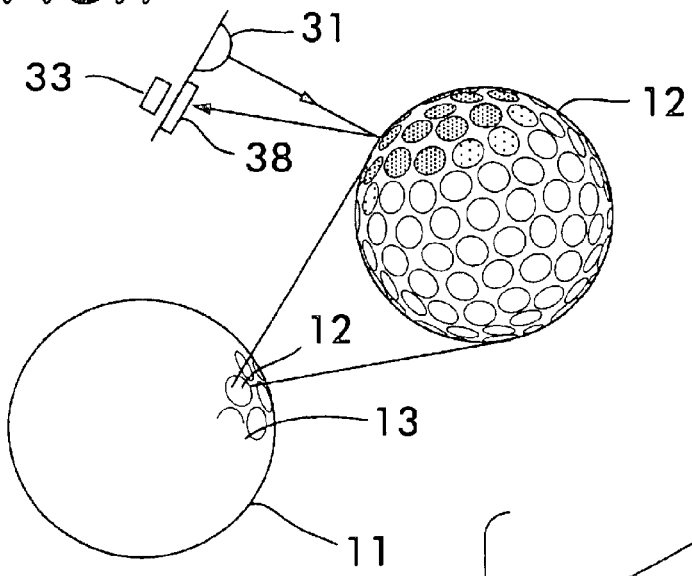
FIG. 8
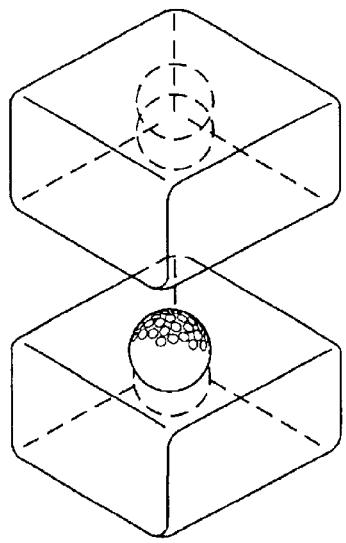
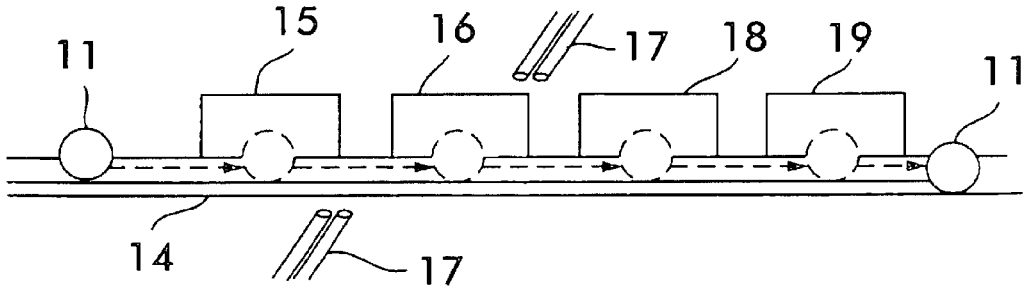
FIG. 9

INFRA-RED LASER DEVICE AND METHOD FOR SEARCHING FOR LOST ITEM

CROSS-REFERENCE

This is a division of application Ser. No. 9/235,618 filed Jan. 21, 1999 which issued a 6,482,108B1 on Nov. 19, 2002.

BACKGROUND

1. Field of Invention

In some athletic games, such as golf, a playing device, such as a golf ball, is temporarily lost, so that one or more players must devote time to searching. Sometimes a golf ball is not found, thus adding to the expense of the sport. Golf balls are not extremely expensive. Few golfers care to spend large amounts for money for a retrieval system involving golf balls costing significantly more than conventional golf balls. The method and apparatus are also useful for searching for and retrieving creatures, experimentally launched model airplanes, or other items which might be temporarily lost.

2. Prior Art

Horchler U.S. Pat. No. 3,782,730 uses a magnetically actuated switch to turn on or off a radio oscillator at the core of the golf ball, whose radio signal can be monitored by the player whenever the ball is temporarily lost.

Engimeier U.S. Pat. No. 5,423,439 employs a rechargeable battery and a system for electromagnetically transmitting energy to the battery charger of a Horchler type of golf ball.

Little U.S. Pat. No. 5,626,531 employs a capacitance system which tags such ball whenever activated by the radiation from by the radiation from a Horchler-type of target-seeking monitor.

Kroll et al U.S. Pat. No. 5,662,534 also uses a monitor sending out a series of pulses of radio beams, and analyzing the reflected radio waves. In Kroll et al, the golf ball feature a generic reflector of such radio beams.

Valintino U.S. Pat. No. 5,132,622 employs a golf ball having a metal center and the combination of a metal detector and target-seeking scoop to retrieve a lost golf ball.

Digital pulses of infra-red laser beams having a wavelength of 1310 nm are suitable for optical wireless systems over distances of a few kilometers, according to Heatley et al, IWWW Communications magazine, December 1998, pp 72–82.

Although radar systems have been helpful in locating gigantic targets, their effectiveness with items as small as a golf ball have been unsatisfactory. Moreover, a golf ball containing significant mass of transmitter, tagging components, capacitors, etc. has flight characteristics which are dysfunctional. Around the world, the number of golfers, and the number of golf balls manufactured, has continued to climb, thus accentuating the long-standing-need for a system for retrieving a temporarily lost ball. Similar problems occur with croquet balls and other sports paraphernalia. Model airplanes and creatures are sometimes temporarily lost, and are retrievable using the apparatus and method of the present invention.

SUMMARY OF THE INVENTION

In accordance with the present invention, a searcher utilizes a monitoring device emitting a laser beam of a particular wavelength, and the reflected light attributable to such laser beam is analyzed for identifying the target zone providing the most intense reflection, inasmuch as the item to be retrieved has been modified to preferentially reflect light when such laser beam reaches it Earphones or a meter, or other appropriate indicating means, can be used in monitoring for the targeted zone having the temporarily lost golf ball or the like. The flight characteristics of the golf ball of the present invention are substantially identical to those of a conventional golf ball, because the ball of the present invention differs from a conventional golf ball only by reason of having on its exterior surface, an appropriate hologram comprising components particularly reflecting a laser beam of predetermined wavelength. In the process of the present invention, a conventional golf ball or [other athletic paraphernalia such as a croquet ball or a model airplane or a creature] is cleaned and then is labeled [usually coated] with the material imparting the selective reflectivity for the laser beam of the preselected wavelength. The term "hologram" is employed for certain types of such selected reflectivity. After the athletic paraphernalia has been thus treated, a sufficient amount of the selected material remains on the item to selectively respond to the laser beam having the pre-selected wavelength. It has been estimated that even after a holgramized ball has been played for 180 holes, or ten rounds of golf, it might retain effective amounts of the hologram material. Some golf balls have a plurality of approximately hemispherical depressions which retain the selective reflectivity even when some of the outermost portions of the ball are dirty. Because the cost of coating the ball with the selective material is not prohibitive, a golf course can repeat the treatment for a ball after even 9 holes of use. Occasionally a freshly hologramized ball becomes excessively dirty and is not adequately responsive to the target-seeking monitoring system featuring the laser beam of predetermined wavelength. However, the dirt accumulated during normal golf games does not impair the effectiveness of the retrieval system of the present invention. The plastic film deposited in a depression of the golf ball can be molded to impart a hologram of the type responsive to the laser beam reaching such molded ridges having angle and spacing appropriate for the selected wavelength.

DRAWING

In the accompanying drawings,

FIG. 1 is a flowsheet of the process of the present invention.

FIG. 2 is a schematic presentation if how a laser beam upon encountering a golf ball having in its dimples an embossed hologram grating of 5 or 15 microns would reflect such laser beam to the monitoring device.

FIG. 3 is a schematic presentation of a monitoring device comprising an emitter of a laser beam of predetermined wavelength; a receptor measuring the reflected light attributable to such laser beam; an indicating means such as a meter having a visual display or an audio signal advising the relative intensity of the reflected light attributable to such laser beam.

FIG. 7 is a schematic view of a laser beam being reflected from a golf ball having an appropriate coating in its dimples.

FIG. 8 is a schematic view of an apparatus for embossing or molding a hologram grating in the coating in the dimples if a golf ball.

FIG. 9 is a schematic presentation of a conveyor system for electrostatically coating a golf ball.

DESCRIPTION OF PREFERRED EMBODIMENTS

EXAMPLE 1

Figure 4:
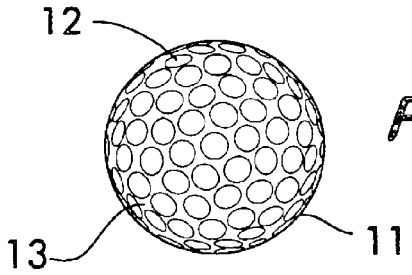
FIG. 4 is a schematic view of a golf ball having dimples or depressions
Figure 5:
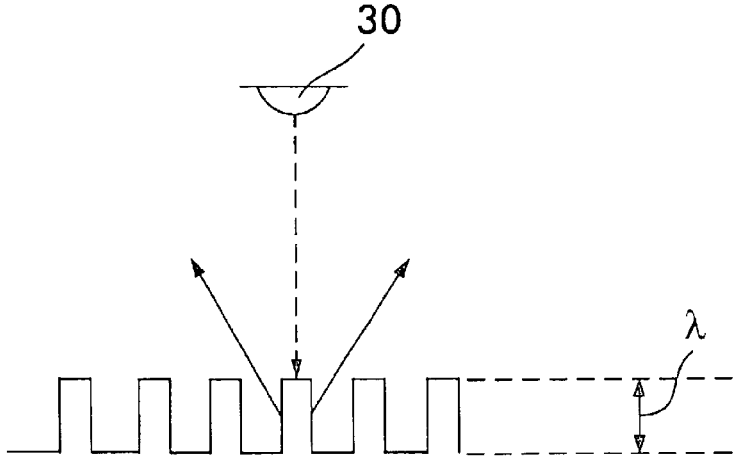
FIG. 5 is a schematic view of angled ridges or grating embossed into the plastic coating of a dimple of a golf ball.
Figure 6:
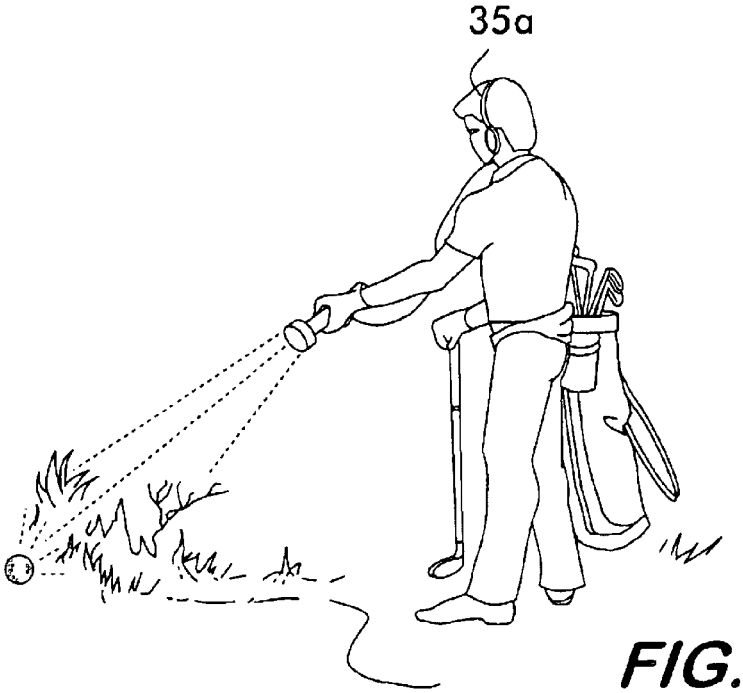
FIG. 6 is a schematic presentation of a search using a monitoring device and earphones to search for a temporarily lost golf ball, thus providing the golfer with audible clues about how accurately he has focused the monitoring device to target the temporarily lost golf ball.

A golf ball 11 having dimples 12 and bumps 13, and resembling that of FIG. 2, is cleaned and then positioned by a plurality of pins on a conveyor system 14 of FIG. 9, The ball is thus advanced through an electrostatic charging system 14 of FIG. 9. The ball is thus advanced through an electrostatic charging zone 1S, shown schematically in FIG. 9, and then into a coating zone 16. Nozzles 17 direct a controlled amount of finely pulverized coating material [having the opposite electrostatic charge] toward the golf ball 11 in the coating zone 16 so that the coating material is applied uniformly to the golf ball 11. The coating particles are a blue pigment consisting of the chelated nickel formate derived from an aqueous solution of the tetra-ammonium salt of ethylene diamine tetra-acetic acid. As a result of the electrostatic attractions, an extremely thin film of the nickel pigment is deposited on the golf ball, the coating being sufficiently uniform that the flight characteristics of the coated ball are not impaired. Optionally, the uniformly coated ball can pass through a heating zone 18 in which the coating is more tenaciously bonded to the surface of the golf ball, and then through a cooling zone 19. After the ball has been thus processed, it is removed from the conveying system 14, and then is ready for use.

During normal use, the ball performs essentially like a similar untreated ball. If, however, a player blunders, and hits a ball into a rough area where it is temporarily lost, the player utilizes a monitoring device 30 (FIG. 2). Such monitoring device 30, as shown in FIG. 3, includes a laser beam generator 31 sending a monochromatic laser beam of pre-selected wavelength from the monitoring device 30 through a central zone. A photoelectric cell 33 detects reflected light attributable to such laser beam, thus generating an electric signal which is amplified by an amplifier 34 for actuating an indicator 35 (FIG. 2) alerting the golfer about the intensity of the reflected laser beam. So long as the laser beam generator directs the laser beam to general areas, only trivial amounts of reflection are indicated. However, when the player has the monitor directed at the temporarily lost ball, the indicator alerts the player that his targeting of the lost ball has started to be useful. On moving closer to the target, the intensity of the indicated reflection is greater. The closer the distance to the target, the more useful are the indications of accurate targeting. Thus a player could retrieve a temporarily lost ball having the coating adapted to reflect the pre-selected wave length of laser beam. Such pre-selected wave length should ordinarily be 1310 nm, but either 1550 nm or 880 nm share with 1310 nm the ability to penetrate atmospheres containing moisture. Communication systems relying upon optical wireless employ digitalized pulses of laser beams, but target-searching laser beams are desirably continuous. The monitoring device 30 comprises a battery pack 36 energizing a power supply 37. A lens 38 focuses the reflected light onto the photoelectric cell 33.

EXAMPLE 2

A blue cobalt pigment comprising phthalimide is dispersed as an emulsion in water, which is applied as a uniform film on the golf ball, which after drying, provides a film which does not impair the flight characteristics of the ball. A grating or ridges having angles is embossed or molded into the coating thus deposited in the dimples. However, such thin film provides excellent reflectivity of a laser beam having the wave-length responsive to such pigment. In quality control tests, the hologram coating is shown to be quite uniform. The flight characteristics of the coated ball match the flight characteristics of an uncoated ball. By using a hand held monitoring device 30 and earphones 35*a*, the player can identify a search zone for a temporarily lost ball, and move closer toward it with increasing accuracy of targeting such lost ball. Upon close proximity, the golf ball is visible, thereby permitting retrieval of such ball.

EXAMPLE 3

A golf ball is dipped in a liquid imparting a thin film of a copolymer featuring vinylchloride. The thus coated ball is transferred to a molding press in which the copolymer film lining each dimple is embossed to provide a plurality of ridges having angles and spacing designed to selectively process a laser beam having a wave length of 1310 nm. Because such laser-responsive ridges are in the dimples, they are not dirtied by the normal use of the golf ball, In the event that such golf ball is temporarily lost, in the rough of a golf course, it can be located by directing a laser beam of 1310 nm toward the search area, and refocusing the monitoring device in response to the audio signals measuring the feedback from such laser beam.

EXAMPLE 4

Each of a plurality of calves is provided with a jacket having a coating of material selectively responsive to a laser beam of 1310 nm and allowed to roam in a pasture. By using the monitoring device emitting such a laser beam and measuring the intensity of the feedback, the monitoring device can be successively refocused a plurality of times for locating each of the wandering calves. The same technique is applicable to model airplanes, prisoners, children, and other items which might be temporarily lost.

The invention claimed is:

1. A monitoring device useful in seeking to retrieve a lost item, said lost item having a hologram attributable to surface components selectively responsive to a laser beam having an explicit wavelength selected from the atmospheric-penetrative identifying group consisting of 880 nm, 1310 nm and 1550 nm, said monitoring device comprising:

a source of electric power;

means actuated by said electrical power for generating a laser beam having a wavelength matching the wavelength for which said components are selectively responsive;

receptor cells responsive to the feedback light from said laser beam;

amplifier means amplifying the electrical signal generated by said feedback when the laser beam scans a search zone possibly containing such temporarily lost item; and indicating means alerting a searcher to the varying intensity of such feedback when the laser beam scans a search zone possibly containing such temporarily lost item.

2. The monitoring means of claim 1 in which the indicating means is an audio signal.

3. The monitoring means of claim 1 in which the laser beam has a wavelength of 1310 nm.

4. A method of seeking to retrieve an item that potentially might become temporarily lost which method comprises:

imparting to an outer surface of said item a hologram by depositing thereon components selectively responsive to a laser beam having an explicit wavelength selected from the atmospheric penetrating identifying group of wavelengths consisting of 880 nm, 1310 nm, and 1550 nm; directing from a monitoring device controlled by the searcher and initially remote from said temporarily lots item a laser beam having the explicit wavelength corresponding to the wavelength for which said hologram is selectively responsive, said laser beam being directed into a search zone in which the temporarily lost item is believed to be, and said laser beam stimulating the reflection from such components of feedback light;

said monitoring device comprising receptor cells responsive to such feedback light, such receptor cells generating an electrical signal;

said monitoring device comprising amplifying means for amplifying such electric signal;

said monitoring device comprising indicating means actuated by such amplifying means for alerting the searcher to the varying intensity of such indicating means when the laser beam scans a search zone possibly containing such temporarily lost item.

5. The method of claim 4 for locating a temporarily lost item in which the hologram is responsive to a laser beam having a wavelength Identified as the atmospheric penetrating wavelength of 1310 nm.

6. The method of claim 4 in which the lost item is a launched experimental device.

7. The method of claim 4 in which the lost item is a golf ball.

8. A golf ball having a hologramized badge on its surface selectively responsive to a laser beam having an atmospheric-penetrating identifying wavelength selected from the group consisting of 880 nm, and 1550 nm.

* * * * *